US009744394B2

(12) United States Patent
Frederick

(10) Patent No.: US 9,744,394 B2
(45) Date of Patent: Aug. 29, 2017

(54) EXERCISING DEVICE WITH MULTI-POSITION HANDLE AND METHOD THEREFORE

(76) Inventor: Kenneth D. Frederick, Huntingdon, PA (US)

( * ) Notice: Subject to any disclaimer, the term of this patent is extended or adjusted under 35 U.S.C. 154(b) by 991 days.

(21) Appl. No.: 13/442,369

(22) Filed: Apr. 9, 2012

(65) Prior Publication Data

US 2012/0264578 A1 Oct. 18, 2012

Related U.S. Application Data

(60) Provisional application No. 61/517,089, filed on Apr. 13, 2011.

(51) Int. Cl.

| | |
|---|---|
| ***A63B 21/00*** | (2006.01) |
| ***A63B 26/00*** | (2006.01) |
| ***A63B 71/00*** | (2006.01) |
| ***A63B 22/20*** | (2006.01) |
| ***A63B 23/12*** | (2006.01) |

(52) U.S. Cl.

CPC ..... *A63B 21/0004* (2013.01); *A63B 21/4035* (2015.10); *A63B 22/20* (2013.01); *A63B 23/1236* (2013.01)

(58) Field of Classification Search

USPC ..... 482/51, 66, 68, 92, 131, 132, 141; 492/13, 14, 47

See application file for complete search history.

(56) References Cited

U.S. PATENT DOCUMENTS

| | | | | |
|---|---|---|---|---|
| 285,476 | A * | 9/1883 | Frink | F28F 5/02 165/89 |
| 1,247,162 | A * | 11/1917 | Southwick | A21C 3/021 492/14 |
| 2,920,418 | A | 1/1960 | Britt | |
| 3,084,547 | A | 4/1963 | Nielsen | |
| 3,403,906 | A | 10/1968 | Burzenski | |
| 3,752,475 | A | 8/1973 | Ott | |
| 3,831,238 | A * | 8/1974 | Adams | B05C 17/0217 492/14 |
| 4,136,867 | A | 1/1979 | Wilkin | |

(Continued)

OTHER PUBLICATIONS

"Pushup Bars" jumpusa.com; Apr. 17, 2007 <http://web.archive.org/web/20070417092521/http://www.jumpusa.com/pushup_bars.html>.*

*Primary Examiner* — Joshua Lee
*Assistant Examiner* — Garrett Atkinson
(74) *Attorney, Agent, or Firm* — James Ray & Assoc. LLC

(57) ABSTRACT

An exercising device includes an axle having a substantially straight portion and a pair of end portions disposed generally perpendicular to the straight portion, at least one wheel mounted for rotation on a peripheral surface of the straight portion and including a center aperture, a sleeve positioned between the peripheral surface of the straight portion and a peripheral surface of the aperture, a pair of collars with a threaded aperture disposed within a thickness of the each of the pair of collars, a pair of threaded fasteners seated within threaded apertures and having an inner end thereof in an abutting engagement with an exterior surface of the axle, a pair of end stops, each of the pair of end stops secured to an end of a respective end portion and at least one grip member disposed on the axle on each side of the at least one wheel.

14 Claims, 6 Drawing Sheets

(56) References Cited

U.S. PATENT DOCUMENTS 4,314,395 A * 2/1982 Brock ..... B44C 7/06 15/230.11
4,639,961 A * 2/1987 Chasan ..... A47C 27/085 5/673
4,862,542 A * 9/1989 Jordan ..... A47C 27/085 5/673
5,000,671 A * 3/1991 Nolte ..... B28B 3/12 134/68
5,261,866 A * 11/1993 Mattox ..... A63B 21/0552 482/125
5,499,961 A * 3/1996 Mattox ..... A63B 21/055 482/123
6,280,369 B1 * 8/2001 Gibran ..... A21C 3/021 492/14
6,638,201 B1 * 10/2003 Dischler ..... A63B 22/20 482/132
7,175,573 B1 * 2/2007 Huang ..... A63B 21/0004 446/236
7,322,905 B2 * 1/2008 Morris ..... A63B 69/345 482/118
7,404,228 B2 * 7/2008 Hodges ..... B05C 17/0217 15/230.11
7,837,603 B1 11/2010 Carnell, Sr.
7,993,250 B2 8/2011 Abbott
8,137,251 B2 * 3/2012 Tozzi ..... A63B 22/203 482/132
2002/0111256 A1 * 8/2002 Tuller ..... A63B 21/026 482/140
2003/0032536 A1 2/2003 Mabe, Jr. et al.
2003/0050153 A1 * 3/2003 Stevens ..... A63B 21/025 482/92
2003/0134726 A1 * 7/2003 Yu ..... A63B 21/00043 482/110
2003/0158023 A1 * 8/2003 Yu ..... A63B 21/0004 482/126
2004/0040111 A1 * 3/2004 Er ..... B05C 17/025 15/230.11
2005/0202944 A1 * 9/2005 Deal ..... A61H 15/0092 482/126
2008/0167168 A1 * 7/2008 Hurst ..... A63B 21/0728 482/132
2009/0064436 A1 * 3/2009 Scott, Sr. ..... B05C 17/0217 15/230.11
2011/0160024 A1 6/2011 Candela et al.
2012/0100969 A1 * 4/2012 Brodbeck ..... A63B 22/20 482/132
2013/0095984 A1 * 4/2013 Agate ..... A63B 21/0618 482/106

* cited by examiner

EXERCISING DEVICE WITH MULTI-POSITION HANDLE AND METHOD THEREFORE

CROSS-REFERENCE TO RELATED APPLICATIONS

This application is related to and claims priority from U.S. Provisional Patent Application Ser. No. 61/517,089 filed on Apr. 13, 2011.

FIELD OF THE INVENTION

The present invention relates, in general, to exercising devices and, more particularly, this invention relates to a portable exercising device for strengthening user's muscles and, yet more particularly, the instant invention relates to a multi-position handle portable exercising device employing a wheel mounted for rotation on an axle that includes a pair of bent end portions.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, exercising devices that include a wheel rotating on an axle are widely used in strengthening abdominal, chest and arm muscles. To use such devices, the user usually kneels down, grasps both handles and rolls the wheel forward and backward.

Examples of the prior art exercise devices can be seen in U.S. Pat. Nos. 7,993,250; 7,837,603; 4,136,867; 3,752,475; 3,403,906; 3,084,547; 2,920,418 and U.S. Pub. No. 2011/0160024 and U.S. Pub. No. 2003/0032536.

However, all prior art devices require the user to grip the device along the axis of rotation in a pronated manner, thus causing greater than desirable stress to shoulder regions.

Therefore, there is a need for an improved exercising device for strengthening user's muscles that minimizes stress to the shoulder regions.

SUMMARY OF THE INVENTION

The invention provides an exercising device. The exercising device includes an axle having a substantially straight portion and a pair of end portions, each of the pair of end portions disposed generally perpendicular to the straight portion and defining a curved juncture region with the straight portion. One or a pair of wheel mounted for rotation on a peripheral surface of the straight portion of the axle and include a center aperture being sized to pass around the curved juncture region. A sleeve is operatively positioned between the peripheral surface of the straight portion of the axle and a peripheral surface of the aperture. There is a pair of collars, each of the pair of collars having a through center aperture sized to receive the peripheral surface of the axle, a threaded aperture disposed within a thickness of the each of the pair of collars in open communication with each of the center aperture of the each of the pair of collars and an exterior surface thereof and being positioned radially to a length of the axle. There is also a pair of threaded fasteners, each of the pair of threaded fasteners seated within a respective threaded aperture and has an inner end thereof in an abutting engagement with an exterior surface of the axle, the abutting engagement sufficient to prevent rotational or axial movement of the each of the pair of collars. The exercising device further includes a pair of end stops, each of the pair of end stops secured to an end of a respective end portion and a pair of grip members disposed on the axle on each side of a respective wheel.

The invention also provides a method of using the exercising device affording also a novel neutral grip position as compared to conventional exercising device only suitable for a pronated grip position.

OBJECTS OF THE INVENTION

It is, therefore, one of the primary objects of the present invention to provide a portable exercising device for strengthening user's muscles.

Another object of the present invention is to provide a portable exercising device for strengthening user's muscles that includes a wheel mounted for rotation on an axle that includes a pair of bent end portions.

A further object of the present invention is to provide a portable exercising device for strengthening user's muscles that includes a wheel mounted for rotation on an axle that includes a pair of bent end portions wherein the axle is provided as a unitary single piece member.

Yet a further object of the present invention is to provide a portable exercising device for strengthening user's muscles that includes a wheel mounted for rotation on an axle that includes a pair of bent end portions wherein the axle is provided as a pair of members secured together during assembly.

An additional object of the present invention is to provide portable exercising device for strengthening user's muscles that includes a wheel mounted for rotation on an axle that includes a pair of bent end portions wherein the end portions are releaseably attached.

Another object of the present invention is to provide a portable exercising device for strengthening user's muscles that includes a pair of wheels mounted for rotation on an axle that includes a pair of bent end portions.

A further object of the present invention is to provide a method of exercising at least one group of muscles by employing the afore-described device including a wheel or a pair of wheels mounted for rotation on an axle that includes a pair of bent end portions.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
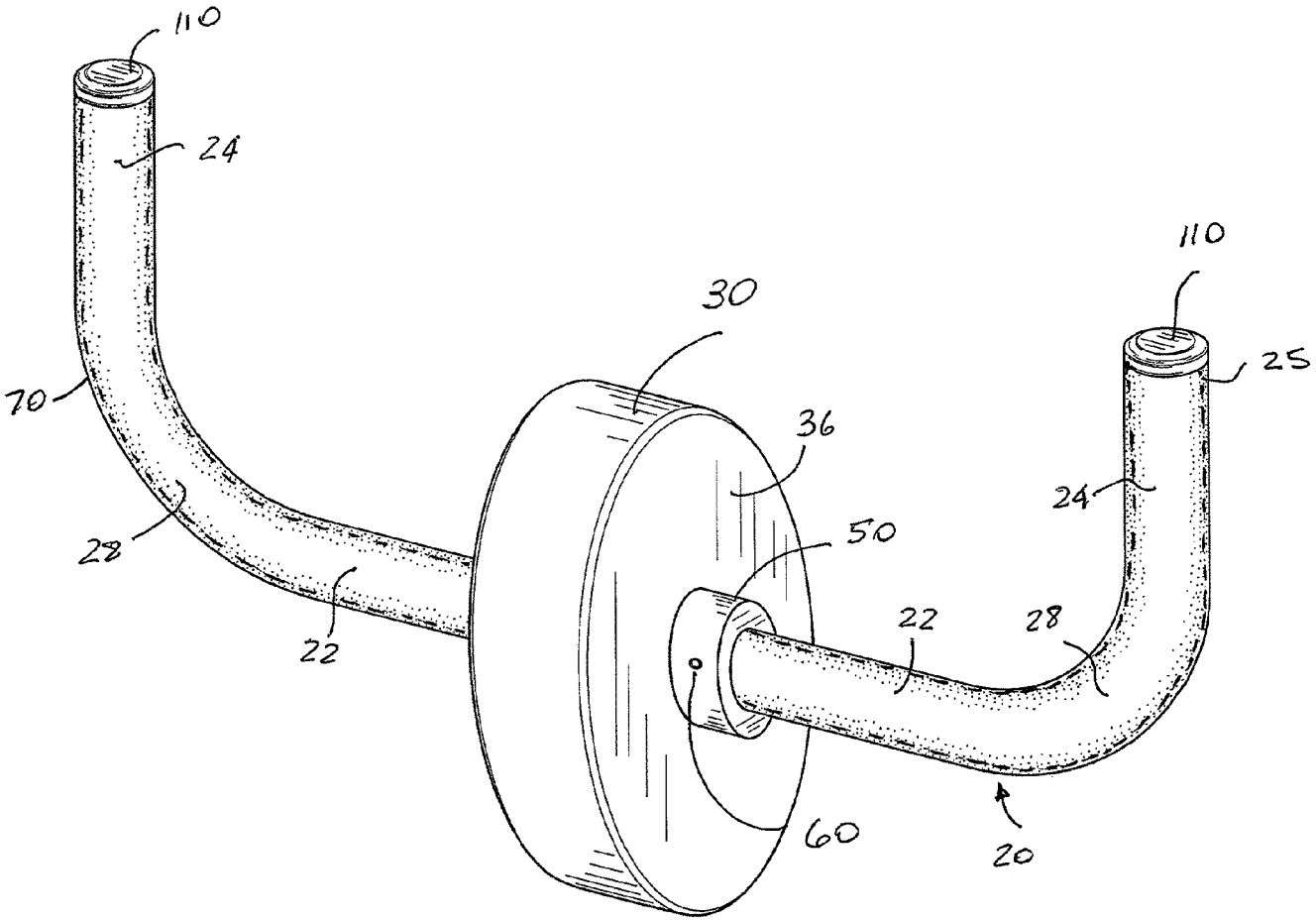
FIG. 1 is a perspective view of a multi-position handle exercising device.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of a neutral grip applies to position of hands during exercising wherein the palms are facing each other and that the definition of a pronated grip applies to position of hands during exercising wherein the palms are facing downwardly.

Reference is now made, to FIGS. 1-10, wherein there is shown an exercising device, generally designated as 10, for exercising at least one group of muscles of a human body 2.

The device 10 includes an axle, generally designated as 20, having a substantially straight portion 22 and a pair of end portions 24. Each of the pair of end portions 24 is disposed generally perpendicular to the straight portion 22, with a deviation from a ninety (90) degree angle allowed due to manufacturing tolerances. At least one wheel 30 is mounted for rotation on a peripheral surface 26 of the straight portion 22 of the axle 20. When such at least one wheel 30 is provided as a disk shaped member having a pair of end surfaces 36 spaced apart along the length of the straight portion 22 so as to define the thickness of the at least one wheel 30, each end surface 36 extends in a plane being generally perpendicular to the length of the straight portion 22 and each end portion 24 extends in a plane being generally parallel to the respective surface 36. A length of each end portion 24 is sized sufficiently to be grasped or gripped by a user during use of the device 10. Equally as well, a length segment of the straight portion 22 adjacent each end surface 36 of the at least one wheel 30 is also sized sufficiently to be grasped or gripped by the user during use of the device 10.

It is presently preferred that the axle 20 is manufactured as a unitary single piece member wherein each end portion 24 is joined to the straight portion 22 by way of a curved region 28, although a sharper connection is also anticipated. Accordingly, the at least one wheel 30 includes a center aperture 32 being sized to pass around such curved region 28 during assembly of the device 10.

It is presently preferred to define the curved regions 28 prior to assembly of the at least one wheel 30. Thus, the device 10 further includes a sleeve 40 having a wall thickness thereof operatively positioned between the peripheral surface 26 of the straight portion 22 of the axle 20 and a peripheral surface 34 of the aperture 32 so as to substantially minimize, if not completely eliminate, movement of the at least one wheel 30 in a direction normal to the length of the straight portion 22, while allowing rotation of the at least one wheel 30. Thus, the exterior peripheral surface 42 of the sleeve 40 sized so as to provide a rotational surface of the at least one wheel 30. During assembly, the sleeve 40, which may be also provided as a conventional bearing, including ball or roller bearing, is seated onto the straight portion 22 prior to one or both of the end portions 24 being defined or formed by a bending process when the axle 20 is manufactured from a metallic material, such as steel, aluminum or a combination thereof. When the axle 20 is manufactured from fiber, plastic or plastic based materials, the sleeve 40 may be defined by a peripheral abutment, as best shown in FIG. 3, representing the thickness of such sleeve 40, during molding or other suitable process. Although, it is also contemplated that peripheral abutment may be provided when the axle 20 is manufactured from metal. The axle 20 may be provided either as a solid member of FIGS. 3 and 5-7, a hollow tubular member of FIGS. 2 and 4 and a combination thereof. The presently preferred shape is the hollow tubular member of FIGS. 2 and 4.

Figure 2:
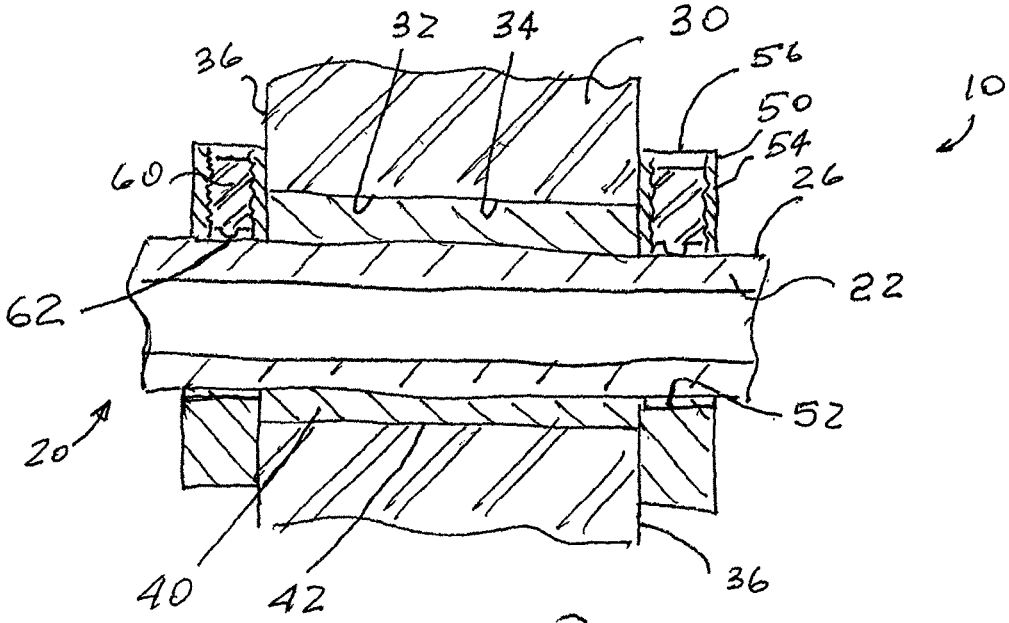
FIG. 2 is one partial cross-sectional view of the exercising device of FIG. 1.
Figure 3:
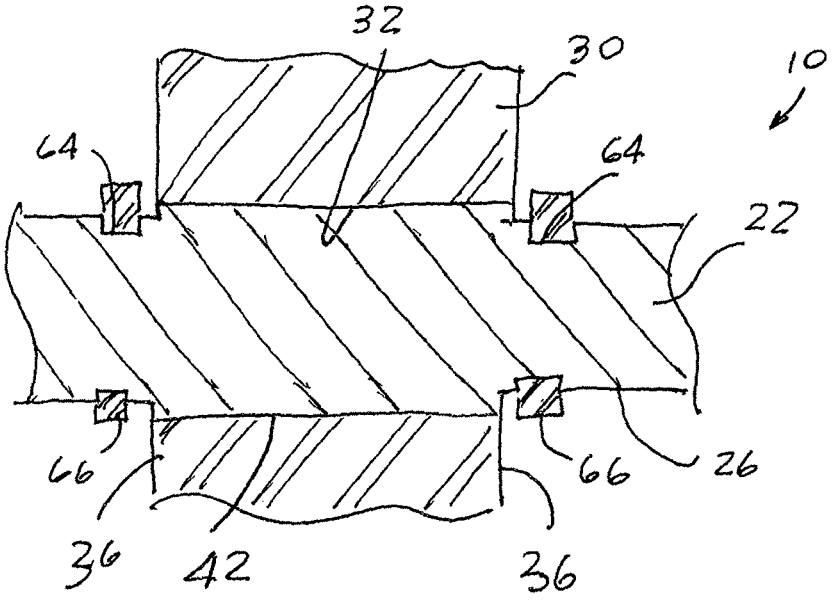
FIG. 3 is another partial cross-sectional view of the exercising device of FIG. 1.

Now in a more particular reference to FIG. 2, the device 10 additionally includes a pair of collars 50. Each of the pair of collars 50 has a through center aperture 52 sized to receive the exterior surface 26 of the axle 20 and a threaded aperture 54 disposed within a thickness of each of the pair of collars 50 in open communication with each of the center aperture 52 and an exterior surface 56 of such each of the pair of collars 50 and being positioned radially to a longitudinal axis of the axle 20. There is also a pair of threaded fasteners 60, with each of the pair of threaded fasteners 60 being seated within a respective threaded aperture 54 and having an inner end 62 thereof positioned during assembly in an abutting engagement with then exterior surface 26 of the axle 20, with such abutting engagement being sufficient to prevent rotational or lateral movement of each of the pair of collars 50. When the curved regions are defined prior to assembly of the at least one wheel 30, the center aperture 52 is sized to allow passage about such curved region 28 during assembly of the device 10. It would be understood that the collars 50 provide means for generally preventing axial movement of the at least one wheel 30 during use of the device 10, although slight axial movement is allowed sufficient to eliminate friction or binding condition during rotation of the at least one wheel 30.

Alternatively, in reference to FIG. 3, such means for preventing axial movement of the at least one wheel 30 may include a pair of circumferential grooves 64 defined in the exterior surface 26 of the straight portion 22 of the axle 20 and being disposed in a spaced apart relationship with each other adjacent each end surface 36 of the at least one wheel 30 and a pair of retaining members 66, each of the pair of retaining members 66 operatively received within a respective circumferential groove 64. Such retaining member 66 is conventionally known as a retaining clip or ring.

Figure 4:
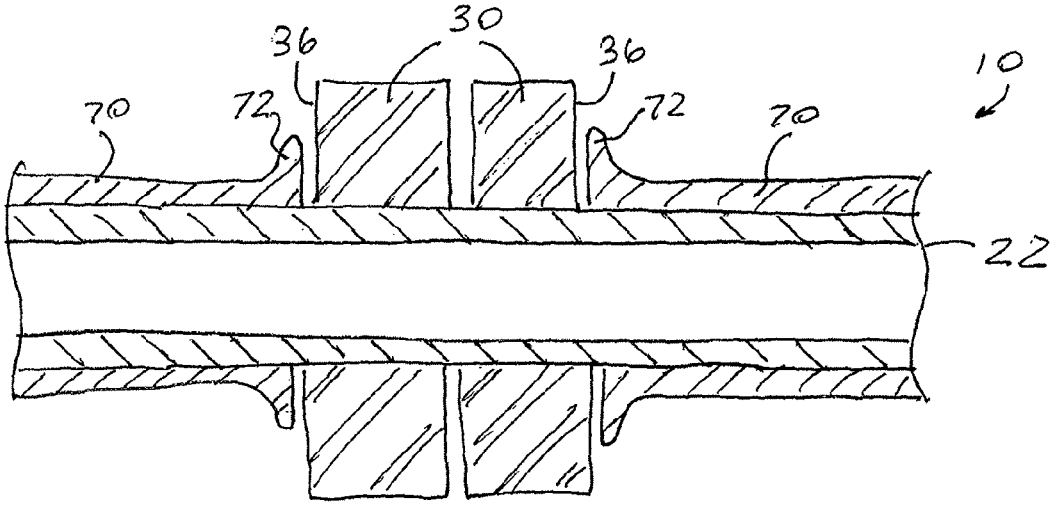
FIG. 4 is yet another partial cross-sectional view of the exercising device of FIG. 1.

In yet another embodiment of FIG. 4, such means for preventing axial movement of the at least one wheel 30 may be provided by a pair of handle grips 70 mounted on the exterior surface 26 of the straight portion 22 adjacent each end surface 36 of the at least one wheel 30, each of the pair of handle grips 70 having a peripheral flange 72 disposed on an end positioned in close proximity to the respective end surface 36 of the at least one wheel 30.

Figure 5:
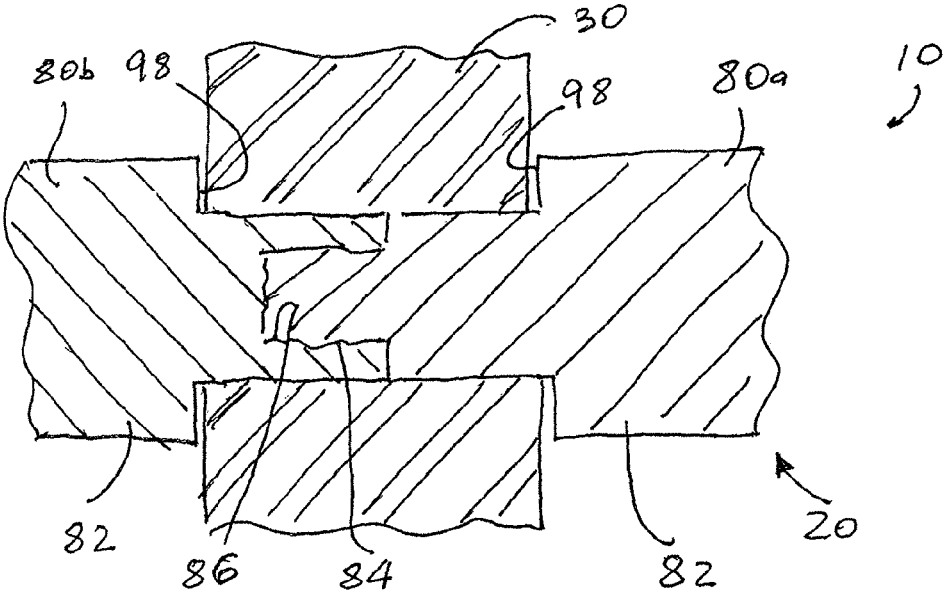
FIG. 5 is a further partial cross-sectional view of the exercising device of FIG. 1.

In another embodiment of FIG. 5, the axle 20 and, more particularly, the straight portion 22 may be provided as a pair of members 80*a* and 80*b*, with the device 10 further including means for at least temporarily securing inner ends 82 of the pair of members 80*a* and 80*b* therebetween. Such means for at least temporarily securing inner ends 82 may include a threaded connection, wherein one end 82 is adapted with a male thread 84 and the other end 82 is adapted with a female thread 86. When the axle 20 has tubular shape, such male thread 84 and female thread 86 may be defined by separate inserts (not shown).

Figure 6:
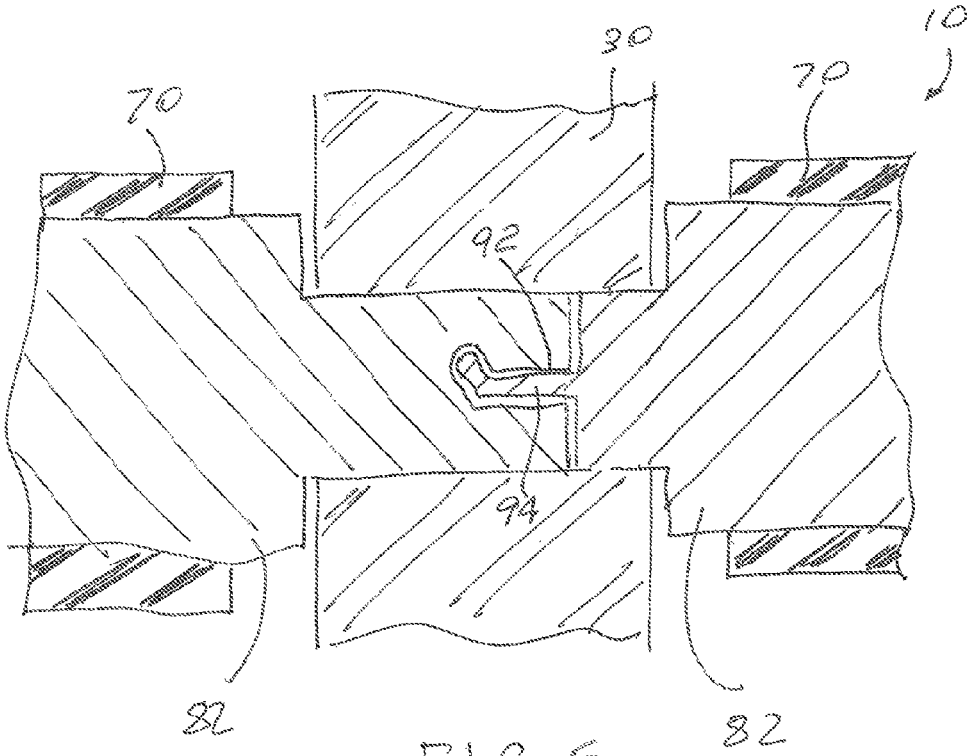
FIG. 6 is another partial cross-sectional view of the exercising device of FIG. 1.

Such means for at least temporarily securing inner ends 82 may also include a cavity 92 formed in one inner end 82 and a protrusion 94 disposed on an opposite inner end 82, as best shown in FIG. 6, the cavity 92 and the protrusion 94 being so sized and shaped that insertion of the protrusion 94 into the cavity 92 and a subsequent rotating motion of one member 80*a* relative to another member 80*b* seats the protrusion 94 within the cavity 92 in a manner sufficient to prevent disengagement of the inner ends 82 from each other along the longitudinal axis of the axle 20. By way of another example, such connection may be of the type as taught in the utility application Ser. No. 10/214,061 filed on Aug. 7, 2002, published as US 2003-0032536A1 on Feb. 13, 2003 and entitled "Portable Exercise Device" and whose teachings are incorporated into this document by reference thereto.

A pair of members 80*a*, 80*b* is advantageous in reducing the size of the device 10 for shipment or storage purposes and is also advantageous for providing a pair of shoulders 98 that in the assembly provide alternative means for preventing axial movement of the at least one wheel 30 during use of the device 10.

The instant invention also contemplates that the end portions 24 may be provided as separate members and being releaseably secured to the straight portion 22 provided either a single piece member or a pair of members 80*a* and 80*b*.

Figure 7:
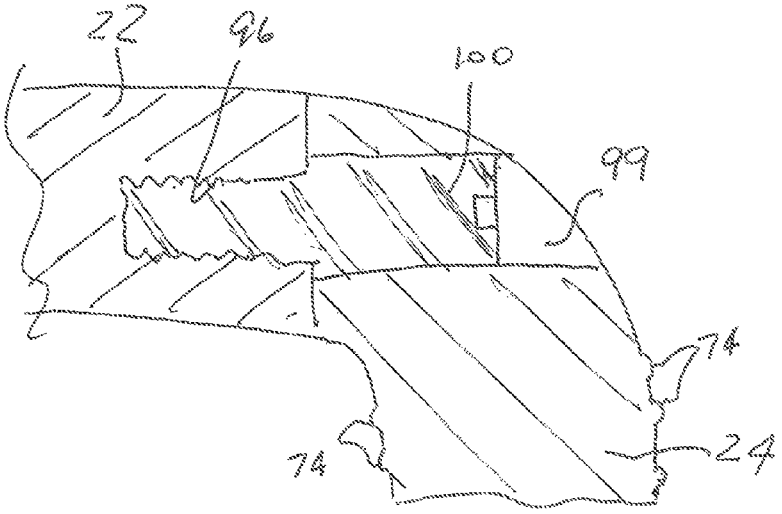
FIG. 7 is yet another partial cross-sectional view of the exercising device of FIG. 1.
Figure 8:
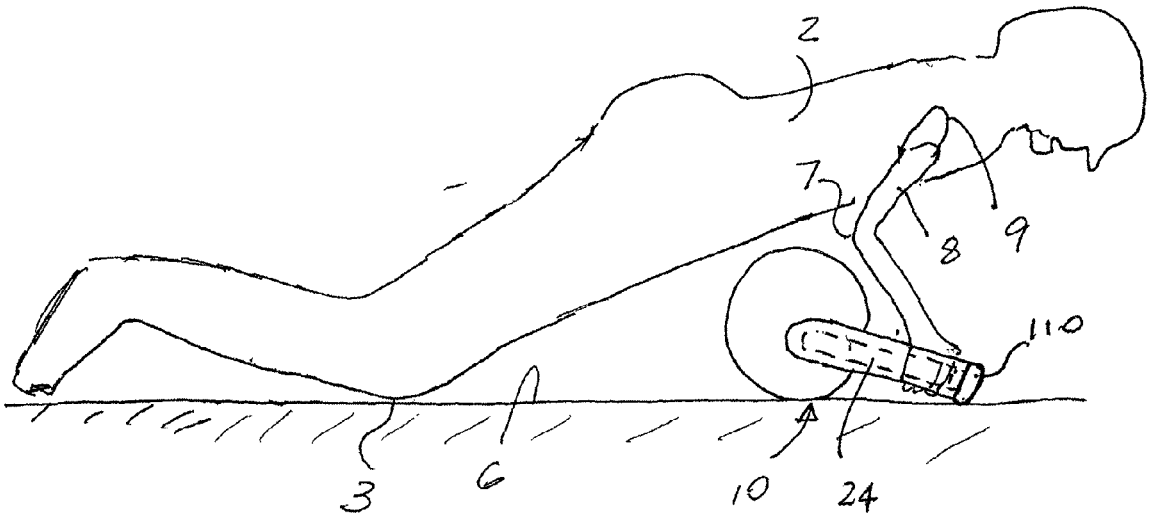
FIG. 8 illustrates a side view of the device of FIG. 1 being used.
Figure 9:
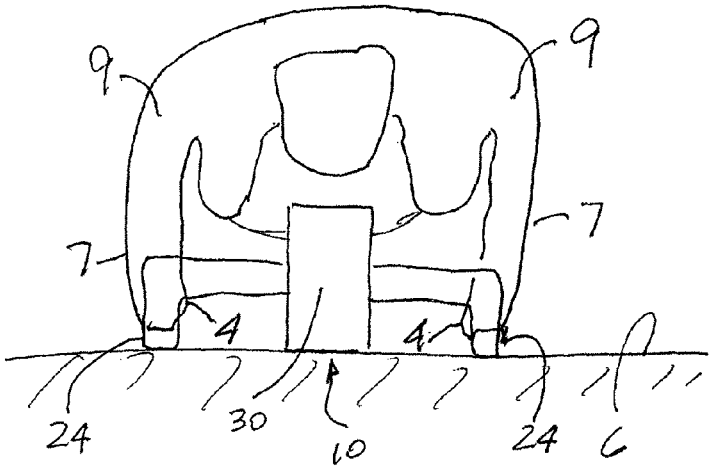
FIG. 9 illustrates a front view of the device of FIG. 1 being used.

By way of one example of FIG. 7, the end portion 24 may be releaseably secured to the straight portion 22 by way of a threaded bore 96 provided within the straight portion 22, a complimentary aperture 99 provided within the end portion 24 and a threaded fastener 100.

Preferably, the handle grip member 70 extends through the curved region 28 and the end portion 24, although a pair of separate grip members on one side of the axle 20 is also contemplated, each covering a straight portion 22 or 24. The handle grip member 70 may be manufactured from foam, rubber or any other conventional material employed in the art of exercising devices. Preferably, the handle grip member 70 is manufactured from Durablend® Foam material from GripWorks of Arnold, Mo. When such handle grip member 70 is provided as Durablend® Foam, it may be necessary to employ lubricant or any other suitable means so as to expedite the installation of such grip member onto the axle 20.

Alternatively, as shown in FIG. 7, the surface 26 of the axle 20 may be provided with raised projections 74 so sized and spaced apart that these projections 74 alone define the sufficient handle grip member. Projections may be made integral with the axle 20 or provided as a separate covering member.

It further presently preferred to terminate each free end of the end portion 24 with a roll stop 110 manufactured from a material that can generate resistance to rolling motion of the at least one wheel 30. By of one example only, such roll stop 110 may be of an Rtil36X type, as available from Component Force LLC of St. Louis Mo., when the axle 20 is manufactured from a tubular material. Alternatively, the outer end of the handle grip member 70 may be utilized for such purpose or the handle grip member 70 may be provided with a closed end that wraps the end 25 of the end portion 24.

Figure 10:
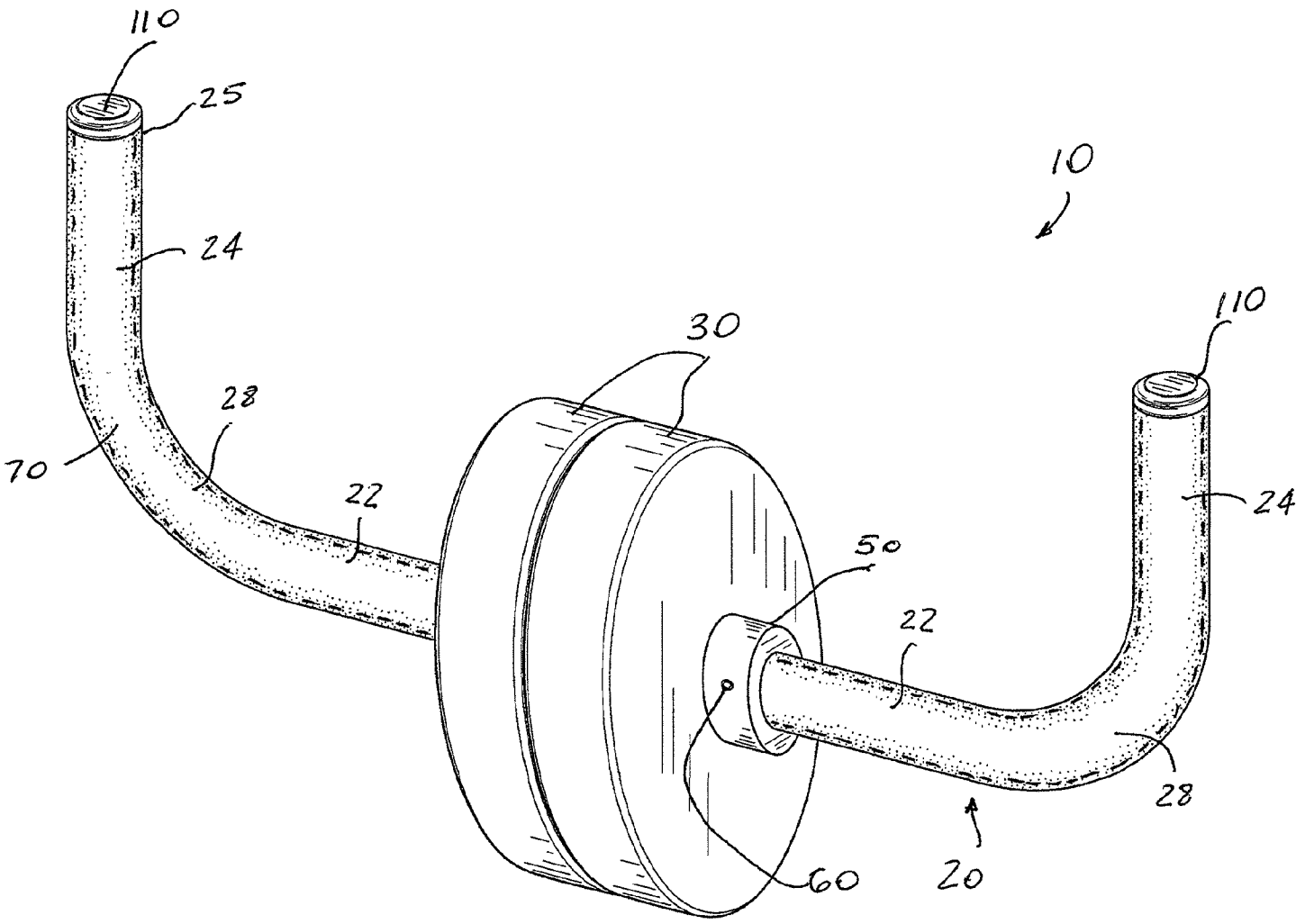
FIG. 10 is another perspective view of a multi-position handle exercising device.

When required, the at least one wheel 30 is provided as a pair of wheels 30 positioned in a side-by-side relationship with each other, as best shown in FIGS. 4 and 10 or provided as a substantially spherical member (not shown).

In another embodiment, the device 10 includes and, preferably only includes, an axle 20 having a substantially straight portion 22 and a pair of end portions 24, each of the pair of end portions 24 disposed generally perpendicular to the straight portion 22 and defining a curved juncture region 28 with the straight portion 22. At least one wheel 30 is mounted for rotation on a peripheral surface 26 of the straight portion 22 of the axle 20, the at least one wheel 30 including a center aperture 32 being sized to pass around the curved juncture region 28 during assembly of the device 10. A sleeve 40 is operatively positioned between the peripheral surface 26 of the straight portion 22 of the axle 20 and a peripheral surface 34 of the aperture 30. A pair of collars 50 is also provided, each of the pair of collars 50 having a through center aperture 52 sized to receive the peripheral surface 26 of the axle 20, a threaded aperture 54 disposed within a thickness of the each of the pair of collars 50 in open communication with each of the center aperture 52 and an exterior surface 56 of the each of the pair of collars 50 and being positioned radially to a longitudinal axis of the axle 20. There is also a pair of threaded fasteners 60, with each of the pair of threaded fasteners 60 being seated within a respective threaded aperture 54 and having an inner end 58 thereof positioned during assembly in an abutting engagement with then exterior surface 26 of the axle 20, with such abutting engagement being sufficient to prevent rotational or lateral movement of each of the pair of collars 50. The device 10 also includes a pair of grip members on each side of the at least one wheel 30 as well as a pair of end stops 110.

It will be understood that straight portion 22 defines handle regions for a conventional pronated grip while end portion 24 define side handle regions for an advantageous neutral grip wherein palms 4 are facing each other, thus providing a multi handle position exercising device.

The instant invention also provides at least one method of exercising at least one group of muscles in the human body 2. Now in a particular reference to FIGS. 8-9, the method includes the essential steps of providing the above described exercising device 10, grasping the end portions 24 of the device 10 in a neutral grip manner, extending and contracting, during reciprocal motion of the device 10, the at least one group of muscles. Generally, the user is kneeling on the surface 6, which may be a conventional floor, that the at least one wheel 30 is rolling on with the reciprocal motion being achieved by pushing the device 10 while lowering the body 2 toward the surface 6 into an extended body position and pulling the device 10 while raising the body 2 of the surface 6 back into the kneeling position.

The step of extending and contracting the at least one group of muscles includes the step of positioning the end portions 24 in a generally vertical plane above the straight portion 22 and maintaining such position during use of the device 10. It has been found that this condition increases the difficulty of the exercise routine, as compared with a conventional pronated grip, and incorporates a variety of core stability and strength exercises and adds the dimension of more intense exercise for grip, forearms, arms, lats, and core.

The step of extending and contracting the at least one group of muscles also includes the step of abuttingly engaging ends 25 of the end portions 24 on the surface 6 so as to temporarily terminate the reciprocal rolling motion of the device 10. When such reciprocal rolling motion is temporarily terminated with the body 2 being lowered to the surface 6, the user can perform push ups while grasping the device 10 with a neutral grip, keeping elbows 7 tucked closer to the body 2 and transferring some of the load to upper arms 8 and away from the shoulders 9. More specifically, in a single repetition, the user, with elbows 7 close to the rib cage, slowly lowers body 2 down towards the surface 6, stopping the descent approximately two (2) inches above the at least one wheel 30 itself. Then the user slowly pushes up the body 2 to starting position. In this exercise routine the neutral grip helps to stabilize wrists 7 and shoulders 9 as well as allowing to position the chest area in close proximity to the surface of the at least one wheel 30. Pressing with the palms facing each other will also create more space under the acromion process (the big bump on the top of the shoulder blade), making the lift easier on the shoulder joints and reducing the risk of injury.

Another exercise routine is referred to as a tricep dip and also uses neutral grip. In this position, the user is seated on the surface 6, with knees 3 bent and the device 10 closely positioned behind the body 2 with the at least one wheel 30 positioned on the surface 6 about one (1) to about two (2) inches from the body 2. The user presses or rotates the end portions 24 down into a roll stop position. Then, in a single repetition, the user raises body 2 up and off the surface 6 and gently lowers the body 2 and, more particularly, the buttocks to within about half inch of the surface 6. The repetition is followed by a short rest, preferably in a range of about thirty (30) to about forty-five (45) seconds before the next repetition.

The instant invention also contemplates additional exercise routines afforded by the neutral grip. On of them is a squat rollout plank exercise from the squatting position wherein the device 10 is positioned between knees 3 and the user performs squatting roll outs to a plank position, employing roll stop feature at full extension. After a brief count, the user reverses roll direction back to squatting position.

Another exercise routine is related to a squat roll out plank exercise routine from standing position, wherein the user squats down with the device 10 positioned between knees 3 knees, grips the end portions 24, rolls out to a plank position, employing roll stop feature at full extension, reverses roll direction to the squatting position and stands up.

Yet another exercise routine is directed to strengthening shoulder muscles wherein user uses the device 10 in a weight bearing exercise by performing lifts with the user griping the end portions 24 and repetitively lifting and lowering the device 10 with arms being in extended position.

The ability to terminate the rolling motion of the device 10 also affords the user a measure of comfort and control over the distance that the at least one wheel 30 actually rolls out until the user has developed sufficient core strength and the capability to perform full roll outs with the maximum extension of the body 2 and when the knees 3 are raised above the surface 6. The rolling motion is initiated or terminated with the device 10 being gripped either in conventional phonated grip manner or a novel neutral grip manner. To initiate the rolling motion, the end portions 24 are raised of the surface 6 while the termination of the rolling motion is achieved by simply tilting wrists downwardly so that the ends 25 touch the surface 6. In a neutral grip manner, it is preferable to position palms 4 closer to the curved region 28.

It has been also found that the neutral grip option, with end portions 24 in either vertical or horizontal position, provides the user with greater body extension when performing roll outs compared to the conventional pronated grip. With neutral grip, the arms of the user are in a lengthened position. This is more of an isometric or static exercise movement, wherein arms remains lengthen during the exercise, instead of a dynamic movement, wherein the arm muscles shorten and extend during the execution of the movement.

Wide varieties of sports require isometric or static strength. Examples include climbing, mountain biking and motocross (grip and upper body strength), Judo, wrestling, alpine skiing (static strength required to stabilize the upper and lower body), shooting, gymnastics and horseback riding. Additionally, activation of the elbow flexors with the upper arms extended out in front and parallel to the surface 6, and hands in a neutral grip position as seen in a grappling clinch, can elicit a different elbow flexor recruitment pattern than that of a conventional bicep curl with arms directly down by the sides. Isometric protocols can be added to any elbow flexor strengthening routine. Key arm muscles, the bicep brachialis and the forearm brachioradialis which are main elbow flexors, are particularly recruited when performing neutral grip exercises such as hammer curls and roll outs with the neutral grip position.

If static strength training is used to increase strength throughout the entire range of motion, isometric exercises should be performed at every 10 to 30 degree increments. If this is too time consuming, it is better to perform exercises at an extended joint angle, rather than a flexed joint angle, as this leads to greater cross-transference of strength at other angles.

Furthermore, the neutral grip is biomechanically superior in comparison to the internally rotated pronated grip commonly associated with regular barbell presses. This help athletes prevent and rehabilitate shoulder injuries.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. An exercising device comprising:

(a) a U-shaped axle made of metal, fiber, plastic, or plastic based materials and having a straight portion and a pair of end portions connected to said straight portion, each of said pair of end portions disposed perpendicular to said straight portion and a peripheral abutment disposed on an exterior surface of said straight portion, said peripheral abutment comprising a sleeve; and (b) at least one wheel directly mounted for rotation on the sleeve.

2. The device, according to claim 1, wherein said axle is manufactured from a unitary single piece member, wherein said at least one wheel includes a center aperture being sized to pass around a curved juncture of each of said end portions with said straight portion wherein a peripheral surface of said sleeve is sized so as to provide a rotational surface of said at least one wheel.

3. The device of claim 2, wherein said sleeve is hollow and operatively positioned between said exterior surface of said straight portion of said axle and a peripheral surface of said center aperture.

4. The device, according to claim 1, further including a pair of circumferential grooves defined in an exterior surface of said axle and disposed in a spaced apart relationship with each other adjacent each end surface of said at least one wheel and a pair of retaining members, each of said pair of retaining members operatively received within a respective circumferential groove.

5. The device, according to claim 1, further including a pair of collars, each of said pair of collars has a through center aperture sized to receive an exterior surface of said axle, a threaded aperture disposed within a thickness of said each of said pair of collars in open communication with each of said center aperture of said each of said pair of collars and an exterior surface thereof and being positioned radially to a length of said axle, and a pair of threaded fasteners, each of said pair of threaded fasteners seated within a respective threaded aperture and has an inner end thereof in an abutting engagement with an exterior surface of said axle sufficient to prevent a rotational or a lateral movement of said each of said pair of collars.

6. The device, according to claim 1, wherein said straight portion includes a pair of members and wherein said straight portion includes a threaded connection between said pair of members.

7. The device, according to claim 1, wherein said straight portion includes a pair of members, wherein a cavity is formed in an inner end of one member and a protrusion is disposed on an inner end of the opposite member, said cavity and said protrusion are so sized and shaped that insertion of said protrusion into said cavity and a subsequent rotating motion of one member relative to the other member seats said protrusion within said cavity in a manner sufficient to prevent disengagement of said inner ends from each other along a longitudinal axis of said axle.

8. The device, according to claim 1, further including a pair of handle grips positioned on an exterior surface of said straight portion adjacent each end surface of said at least one wheel, each of said pair of handle grips having a peripheral flange disposed on an end positioned in close proximity to said end surface of said at least one wheel.

9. The device, according to claim 1, wherein each of said pair of end portions is releaseably secured to a respective end of said straight portion.

10. The device, according to claim 1, wherein each end portion extends in a plane being parallel to a plane of a respective end surface of said at least one wheel.

11. The device, according to claim 1, wherein a length of each end portion is sized sufficiently to be grasped during use of said device.

12. The device, according to claim 1, wherein a length segment of said straight portion adjacent each end surface of said at least one wheel is sized sufficiently to be grasped during use of said device.

13. The device, according to claim 1, wherein said at least one wheel is a pair of wheels.

14. An exercising device comprising:

(a) a U-shaped axle having a straight portion and a pair of end portions, each of said pair of end portions connected to and disposed perpendicular to said straight portion and defining a curved juncture region with said straight portion;

(b) at least one wheel mounted for rotation on a peripheral surface of said straight portion of said axle, said at least one wheel including a center aperture being sized to pass around said curved juncture region;

(c) a sleeve operatively positioned between said peripheral surface of said straight portion of said axle and a peripheral surface of said center aperture;

(d) a pair of collars, each of said pair of collars having a through center aperture sized to receive said peripheral surface of said axle, a threaded aperture disposed within a thickness of said each of said pair of collars in open communication with each of said center aperture of said each of said pair of collars and an exterior surface thereof and being positioned radially to a longitudinal axis of said axle;

(e) a pair of threaded fasteners, each of said pair of threaded fasteners seated within a respective threaded aperture and has an inner end thereof in an abutting engagement with an exterior surface of said axle, said abutting engagement sufficient to prevent rotational or axial movement of said each of said pair of collars;

(f) a pair of end stops, each of said pair of end stops secured to an end of a respective end portion; and (g) at least one grip member disposed on said axle on each side of said at least one wheel.

* * * * *